United States Patent [19]

Kratz

[11] 3,945,335

[45] Mar. 23, 1976

[54] BOAT DOCKING DEVICE

[76] Inventor: David W. Kratz, 17 Country Life Acres, St. Louis County, Mo. 63131

[22] Filed: Dec. 13, 1974

[21] Appl. No.: 532,394

[52] U.S. Cl. ..... 114/221 R; 114/230; 294/19 R

[51] Int. Cl.[2] ..... B63B 21/04

[58] Field of Search ..... 114/221 R, 230, 223; 294/90; 119/151, 153; 24/252 R, 252 H

[56] References Cited

UNITED STATES PATENTS

| | | | |
|---|---|---|---|
| 383,803 | 5/1888 | Evans | 114/223 |
| 2,811,127 | 10/1957 | Palsson | 114/221 R |
| 2,913,797 | 11/1959 | Hollis et al. | 114/230 X |
| 3,588,161 | 6/1971 | Sayre | 294/19 R |
| 3,841,685 | 10/1974 | Kolodziet | 294/19 R |

*Primary Examiner*—Trygve M. Blix
*Assistant Examiner*—Gregory W. O'Connor
*Attorney, Agent, or Firm*—Ralph W. Kalish

[57] ABSTRACT

A device for use with a conventional loop-provided boat line to effect docking or mooring of boats comprising a pair of rigid arms for detachable engagement upon opposed portions of the strands of the loop near the base thereof; there being a pivotal connection between each of the rigid arms adjacent their rearward or loop remote ends for swingable movement of the same away from and toward each other, or into open or closed condition, respectively. The rearward ends of these arms are formed to provide cooperating jaws for clamping relationship upon an interposed implement as the arms are moved away from each other for loop opening through a pulling force upon the line.

14 Claims, 5 Drawing Figures

BOAT DOCKING DEVICE

BACKGROUND AND SUMMARY OF THE INVENTION

This invention relates in general to boat line handling and, more particularly, to a device for use in docking or mooring boats.

It is an object of the present invention to provide a device for facilitating the securing of a boat line to a mooring connection, such as a post, piling, cleat, or the like; the operation of which does not require developed skill on the part of the user.

It is another object of the present invention to provide a device of the character stated which may be readily affixed upon a conventional boat line without requiring modification thereof.

It is a further object of the present invention to provide a device of the character stated which is uniquely adapted for operation in conjunction with the customary boat hook so that the same is completely functional with equipment normally contained in a boat.

It is another object of the present invention to provide a device of the character stated which is reliable in usage; which is comprised of wear-resistant parts, which do not interfere with the normal storage of the associated line.

DESCRIPTION OF THE PREFERRED EMBODIMENT

Figure 1:
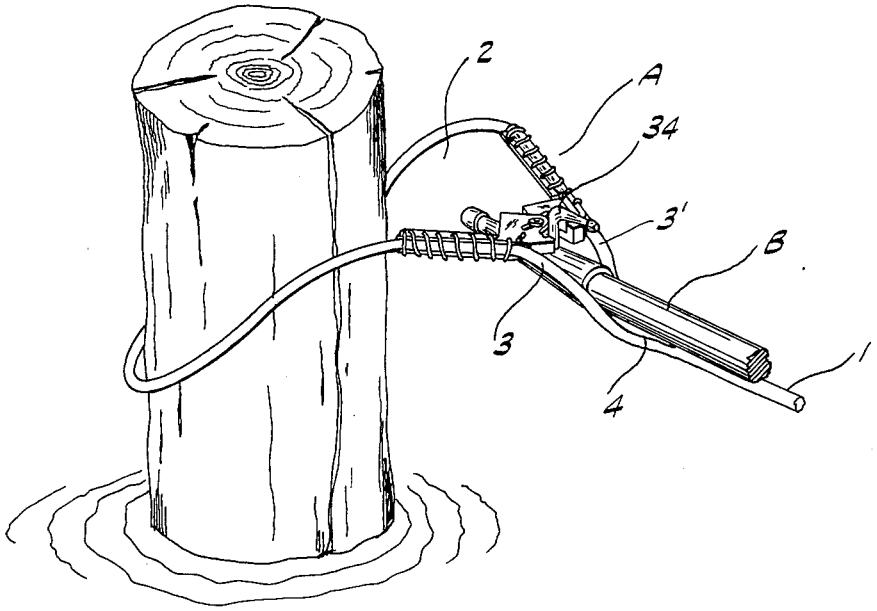
FIG. 1 is a perspective view of a docking device constructed in accordance with and embodying the present invention illustrating the same in open condition with the associated line loop received about a piling.

Referring now by reference numerals to the drawings which illustrate the preferred embodiment of the present invention, A designates a docking device for use with a conventional boat line 1 in securing boats to mooring connections, such as, posts, cleats, pilings, and the like. Boat line 1, being fabricated of rope, plastic, or like flexible material, is provided at its outer end with the usual loop 2 formed as by doubling the line upon itself with the development of strands 3,3′ which progress from a loop base 4, or branch from a point of jointure resulting from securement of the normally outer free end of the line upon the body thereof; said strands 3,3′ unitarily merging in their outer portions. Proximate, but spacedly from, loop base 4, there is mounted upon each strand 3,3′ upon its inwardly directed portion, a docking device arm 5,5′, respectively, made of rigid wear-resistant material, such as plastic, metal, and the like; with each arm comprising a body 6,6′ on the outer surface of which is disposed a substantially coextensive outwardly opening groove 7,7′, respectively, for receiving a portion of the related strand 3,3′ whereby the reliability of engagement of arms 5,5′ is relatively enhanced. Arms 5,5′ are maintained upon the respective strands 3,3′ as by lacing 8,8′, respectively, as constituted of cord or the like, which is threaded through a series of apertures as indicated broadly at 9,9′, respectively, arranged lengthwise of arms 5,5′ as within a fin-like projection 10,10′ on the inner portion of body 6,6′, respectively, of arms 5,5′ as well as within the rearward portions of bodies 6,6′, as at 11,11′; there being at the forward or loop adjacent end of projections 10,10′ a recess 12,12′, respectively, for securing the normally outer knotted end of each lacing 8,8′ to prevent inadvertent loosening thereof.

By means of lacing 8,8′, arms 5,5′ of docking device A are detachably mounted upon the related strands 3,3′ so as to be resistant to both axial, as well as rotative displacement. It is to be recognized that the disclosure concerning the utilization of lacing 8,8′ as a means of steadfastly interengaging strands 3,3′ and arms 5,5′ is for purposes of illustration only, as it is obvious that resort may be made to numerous expedients for effecting such securement. The lacings provide a very simple means for permitting facile application of arms 5,5′ of docking device A upon a boat line. At their rearward end, or loop base-adjacent portions, the bodies 6,6′ of each arm 5,5′ is integrally provided with a flat plate 13,13′, respectively, projecting inwardly therefrom, that is, toward the opposite arm; each of said plates 13,13′ being planarwise parallel with the related fin projection 10,10′ and commencing at the rearward end thereof. Plates 13,13′ are substantially laterally offset from the associated fin projection 10,10′ and have a thickness approximately one-half that of the transverse dimension of the related arm body 6,6′. Each plate 13,13′ is provided with a leading edge 14,14′ which is substantially axially perpendicular to the longitudinal axis of the respective arm 5,5′; with an outer lateral edge 15,15′, respectively, which throughout substantially its length, is perpendicular to the associated leading edge 14,14′, respectively, and which in its rearward end portion is continuous with the rearward end or trailing edge 16,16′ of plates 13,13′, respectively, through an arcuate or rounded corner 17,17′, respectively. Said rearward end edges 16,16′ are each contoured to present a generally V-shaped, rearwardly opening recess 18,18′ having converging sides 19,20 and 19′,20′, respectively, the sides 20,20′ terminate at the rearward ends 21,21′ of arms 5,5′, respectively.

Figure 4:
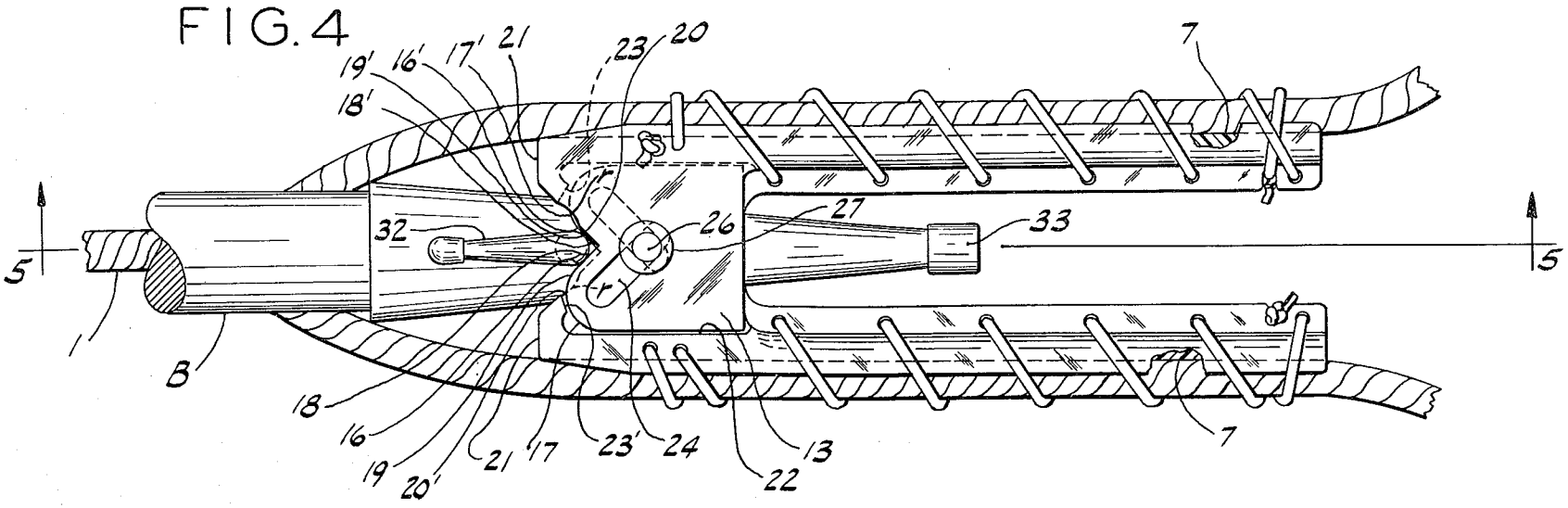
FIG. 4 is an enlarged, fragmentary top plan view of the device as shown in FIG. 3.
Figure 5:
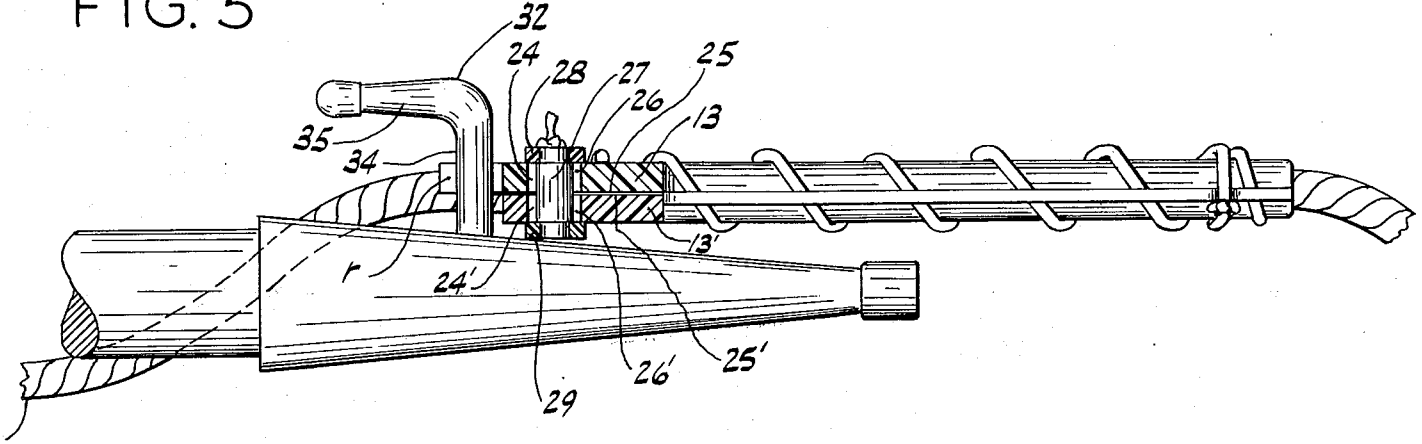
FIG. 5 is a vertical transverse sectional view taken on the line 5—5 of FIG. 4.

Each arm 5,5′ on its inner surface adjacent the associated plate 13,13′ is provided with a shoulder 22,22′, respectively, having a transverse extent substantially the same as the thickness of the related plate 13,13′; each of said shoulders is continuous with a forwardly directed abutment 23,23′, respectively, on the adjacent rearward end portion of the respective arm 5,5′. As may best be seen in FIG. 4, each plate 13,13′ has formed therein an elongated slot-like aperture 24,24′, respectively, the longitudinal axis of each of which is at an angle of less than 90° to the longitudinal axis of the associated arm 5,5′.

In presenting arms 5,5′ to each other for interengagement one is merely turned through an angle of 180° to the other so that plates 13,13′ are brought into surface abutment upon their shoulder adjacent faces, as at 25,25′; and with their respective lateral edges 15,15′ abutting against shoulders 22′,22, respectively, of the other arm 5,5′ (see FIG. 4) in which condition it will be observed that the rearward arcuate corners 17,17′ engage abutments 23′,23, respectively, and with the axes of slots 24,24′ in intersecting relationship. Said slots 24,24′ are of such length that their normally forward end portions as at 26,26′ are in registration (FIG. 4) when said plates 13,13′ are disposed as immediately above described for accepting a pivot pin 27 extending therethrough. Pin 27 is headed at its opposite ends, or normally upper and lower ends, as at 28,29, respectively, to prevent disengagement.

Pin 27 has a diameter less than the minimum transverse dimension of slot-like apertures 24,24′ so as to be relatively freely movable therein without causing any binding action, whereby arms 5,5′ are easily movable with respect to each other. With plates 13,13′ in alignment, and plate edges abutting the opposed shoulders 22,22′, arms 5,5′ are in axial parallel relation with recesses 18,18′ in registration. In such condition, arms 5,5′ are at the inner limit of their arc of swing about pin 27, which condition is sometimes referred to herein as "loop closed condition" wherein loop 2 is closed.

It will be seen that the rearward ends 21,21′ of arms 5,5′ are spaced forwardly of loop base 4 to define, together with the included portions of strands 3,3′, a relatively enlarged eyelet 30.

Device A is peculiarly adapted for utilization with a conventional boat hook indicated broad at at B, and which comprises the usual, elongated pole or rod 31 having a hook 32 affixed adjacent its normally dock engaging end 33. Hook 32 is of the customary, generally L-shape, having a leg portion 34 substantially perpendicular to the axis of pole 31 and an outer leg portion 35 turned rearwardly in axially normal relationship to leg 34.

Figure 2:
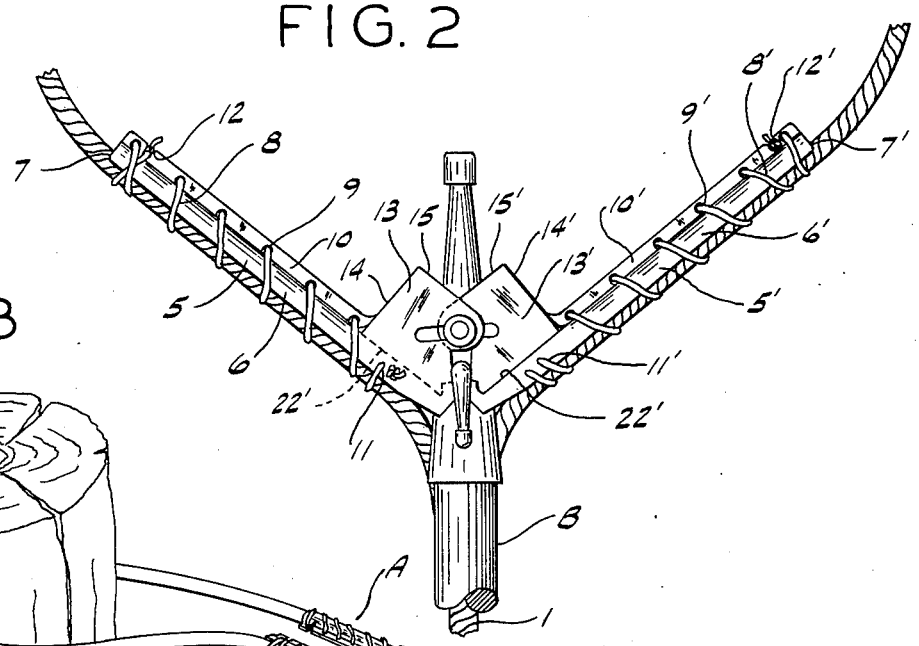
FIG. 2 is an enlarged fragmentary top plan view of the device as shown in FIG. 1.
Figure 3:
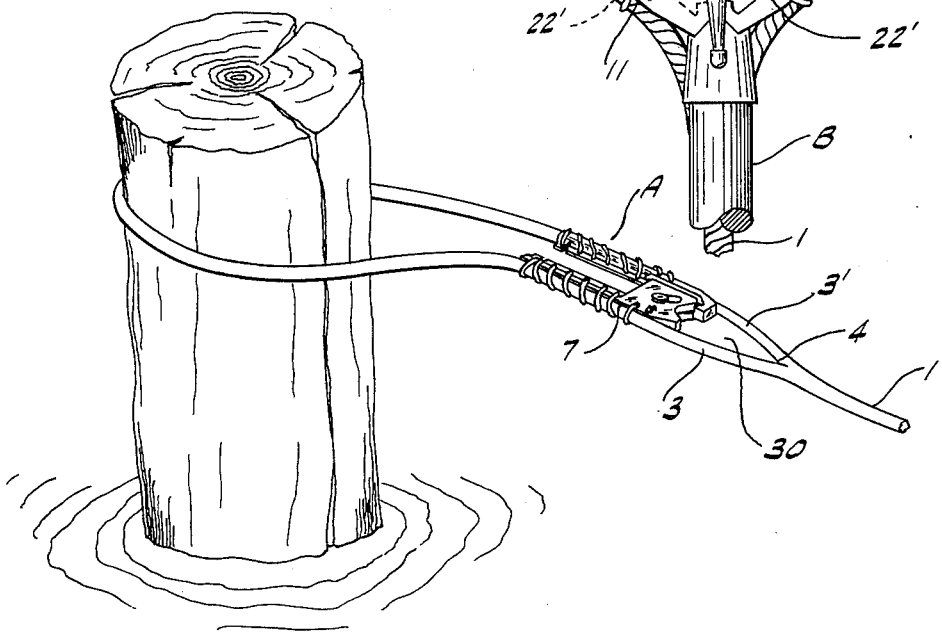
FIG. 3 is a perspective view of the docking device in closed condition with the associated line loop fast about a piling.

In actual usage, arms 5,5′ of docking device A are, as by hand, brought toward each other into closed condition (FIG. 4) and the outer or dock engaging end 33 of boat hook B is passed through eyelet 30 to present leg portion 34 of hook 32 within the composite recess as formed by the registering recesses 18,18′ or plates 13,13′, respectively. The inner or loop remote end of line 1 is gripped in one of the user's hands, while with the other hand boat hook B is held so as to urge hook leg portion 34 against the registering recesses 18,18′. By pulling and, hence, applying tension upon line 1, with movement thereof being inhibited by hook leg portion 34, strands 3,3′ will tend to spread with arms 5,5′ being swung away from each other as plates 13,13′ swing about pivot pin 27 causing the sides 19,20′ and 19′,20 of recesses 18,18′ to act as jaws effecting a snug clamping engagement upon hook leg portion 34. The extent or degree of swing is controlled by the length of slot-like apertures 24,24′, as with arms 5,5′ in full open position (FIG. 2), pin 27 will abut against the opposite now registering ends of the related apertures 24,24′, having traveled relatively therealong. Thus, with pin 27 in such position, and with the axes of apertures 24,24′ in substantially parallel relation, arms 5,5′ will have reached the outer limit of their swing and thus be in full opened condition. The length of apertures 24,24′ permit of substantially wide parting of arms 5,5′ by which loop 2 is correspondingly opened so that it may be easily disposed about a mooring connection, such as a post, stanchion, cleat, and the like. Thus, in this state, with boat hook B retained in engaged position with respect to arms 5,5′, the operator will suitably throw the opened loop about the mooring connection. With loop 2 so engaged thereabout, FIG. 1, the operator will then withdraw boat hook B relieving the pressure upon arms 5,5′ so that upon a continued line tension, such as by movement of the docked boat, the said arms may draw freely toward each other into closed condition (FIG. 3) rendering the mooring all the more fast.

Conversely, when it is desired to disengage line 1, boat hook 32 will be reinserted through eyelet 30 and leg portion 34 received within the rearward end recess. Thus, by applying tension upon line 1, arms 5,5′ will move away from each other to thereby spread loop 2 into open condition to facilitate its being lifted from the mooring connection.

In view of the foregoing it is readily apparent that the present invention markedly easily promotes mooring and disengaging operations by the simple expedient of a device used in conjunction with conventional equipment, namely a boat line with the usual loop and a customary boat hook. Furthermore, it is to be particularly observed that arms 5,5′ are of but limited dimensions so that the same do not interfere with the storage of line 1 during periods of disuse as when coiled upon a deck or the like. It may be additionally observed that the device of the present invention is useful with lines of all types and easily applied to existing lines without requiring time-consuming or costly modification of the same.

Although not requisite for effective functioning, the sides 20,20′ may have inwardly concave portions, as at *r*, for conformity to the rounded character of leg portion 34 of hook 32 to enhance the engagement therewith.

Having described my invention, what I claim and desire to obtain by letters patent is:

1. The combination of a flexible boat line having a loop formed in one end portion thereof encirclable about a mooring device, said loop having a base portion with opposing strands progressing therefrom, and of a docking device comprising a pair of rigid arms in correspondence to said strands, each arm having outer and inner ends, the outer ends of said arms terminating spacedly inwardly of the bight portion of said loop, means securing each of said arms rigidly on the related line strand, said securing means inhibiting relative movement of said arms with respect to the engaged strands so that the same at all times act unitarily, said arms having their inner ends relatively proximate said loop base portion, and means pivotally interengaging said arms at their inner end portions premitting swinging of the same together with the engaged portions of said strands away from each other for opening of said loop.

2. The combination defined in claim 1 and further characterized by said arm mounting means permitting ready detachability of said arms.

3. The combination defined in claim 2 and further characterized by said arm mounting means being lacing threaded about said arms and the associated line strand.

4. The combination defined in claim 1 and further characterized by each of said arms having an outwardly opening substantially coextensive groove for receiving the inner portion of the related line strand and means for limiting the movement of said arms toward each other.

5. The combination defined in claim 4 and further characterized by said arms being mounted upon the related line strands so as to present their loop base proximate ends spacedly from the loop base.

6. The combination defined in claim 1 and further characterized by a plate portion being provided upon each arm in the end portion thereof proximate the loop base, the plate portions of said arm being disposed in planar parallel relationship, said means pivotally interengaging said arms being provided within said plate portions.

7. The combination defined in claim 6 and further characterized by said plates having a leading edge, a lateral edge, and a trailing edge, said trailing edge contoured to define an end opening recess.

8. The combination defined in claim 7 and further characterized by said trailing edge recess being of general V-shape having converging edge portions whereby upon outward swinging of said arms, edge portions of the trailing edge of the said plate portions will move toward each other in the manner of clamping jaws.

9. The combination defined in claim 8 and further characterized by edge portions of the trailing edge of said plate portions having concave indentations.

10. The combination defined in claim 9 and further characterized by each of said arms having a shoulder for abutment with the lateral edge of the plate portion of the opposite leg for limiting the movement of said arms toward each other.

11. The combination defined in claim 6 and further characterized by each of said plate portions having an opening, and a pivot pin extending through said plate portion openings with its axis normal to the plane of said plate portions.

12. The combination defined in claim 11 and further characterized by said plate portion opening being of elongated slot-like character and with their axes forming an angle of less than 90° with the longitudinal axis of the related arm.

13. The combination defined in claim 12 and further characterized by said openings being in axial intersecting relationship when said arms are in closed condition and being in axial parallel relation when said arms are open.

14. The combination defined in claim 13 and further characterized by said openings having an extent substantially greater than the diameter of the pivot pin whereby the latter moves along said openings during opening and closing movement of said arms.

* * * * *